US010467969B2

(12) United States Patent
Liu

(10) Patent No.: US 10,467,969 B2
(45) Date of Patent: Nov. 5, 2019

(54) DRIVING METHOD, LIQUID CRYSTAL DISPLAY PANEL AND ELECTRONIC DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventor: Lei Liu, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/560,026

(22) PCT Filed: Feb. 8, 2017

(86) PCT No.: PCT/CN2017/073103
§ 371 (c)(1),
(2) Date: Sep. 20, 2017

(87) PCT Pub. No.: WO2017/206540
PCT Pub. Date: Dec. 7, 2017

(65) Prior Publication Data

US 2018/0182322 A1 Jun. 28, 2018

(30) Foreign Application Priority Data

Jun. 2, 2016 (CN) ..... 2016 1 0387732

(51) Int. Cl.
*G09G 3/36* (2006.01)

(52) U.S. Cl.
CPC ..... *G09G 3/3607* (2013.01); *G09G 3/3614* (2013.01); *G09G 3/3648* (2013.01);
(Continued)

(58) Field of Classification Search
CPC ..... G09G 3/3607; G09G 3/36; G09G 3/3614; G09G 3/3648; G09G 2300/0823; G09G 2310/027
(Continued)

(56) References Cited

U.S. PATENT DOCUMENTS

2012/0154358 A1 6/2012 Chen et al.
2014/0071188 A1 3/2014 Oh et al.
(Continued)

FOREIGN PATENT DOCUMENTS

CN 101363979 A 2/2009
CN 102136244 A 7/2011
(Continued)

OTHER PUBLICATIONS

The First Chinese Office Action dated Nov. 23, 2017; Appln. No. 201610387732.X.
(Continued)

*Primary Examiner* — Jennifer Mehmood
*Assistant Examiner* — Ngan T Pham Lu

(57) ABSTRACT

A driving method, a liquid crystal display panel, and an electronic device are described. The driving method is applicable to a liquid crystal display panel, the liquid crystal display panel including a plurality of first data lines and includes: grouping the plurality of first data lines into a plurality of sub-groups, each sub-group including a plurality of second data lines; determining a gray-scale value difference of data on each data line from a gray scale of a previous row to a gray scale of a next row, with respect to the plurality of second data lines of each sub-group; and selectively performing charge sharing with the plurality of second data lines in each sub-group, according to the determined gray-scale value difference.

13 Claims, 7 Drawing Sheets

(52) U.S. Cl.
CPC ..... *G09G 2300/0823* (2013.01); *G09G 2310/027* (2013.01); *G09G 2310/0251* (2013.01); *G09G 2330/021* (2013.01); *G09G 2330/023* (2013.01)

(58) Field of Classification Search
USPC ..... 345/690
See application file for complete search history.

(56) References Cited

U.S. PATENT DOCUMENTS

| | | | | |
|---|---|---|---|---|
| 2015/0287374 | A1* | 10/2015 | Chen | G09G 3/3688 345/98 |
| 2016/0071455 | A1* | 3/2016 | Jung | G09G 3/20 345/209 |

FOREIGN PATENT DOCUMENTS

| | | | |
|---|---|---|---|
| CN | 102184700 | A | 9/2011 |
| CN | 102779492 | A | 11/2012 |
| CN | 103366670 | A | 10/2013 |
| CN | 103680436 | A | 3/2014 |
| CN | 103985347 | A | 8/2014 |
| CN | 105405379 | A | 3/2016 |
| CN | 105869594 | A | 8/2016 |
| KR | 1020110067355 | A | 6/2011 |
| KR | 1020140035197 | A | 3/2014 |
| KR | 1020160029544 | A | 3/2016 |

OTHER PUBLICATIONS

International Search Report and Written Opinion dated May 17, 2017; PCT/CN2017/073103.

* cited by examiner

DRIVING METHOD, LIQUID CRYSTAL DISPLAY PANEL AND ELECTRONIC DEVICE

TECHNICAL FIELD

The present application relates to a driving method, a liquid crystal display panel, and an electronic device.

BACKGROUND

A liquid crystal display panel has been widely used in various electronic devices as a display device due to advantages such as energy saving, light weight, flat profile, no radiation, and the like.

However, at present, in products, such as mobile electronic devices, the requirement on power consumption of the products is becoming higher and higher, so as for liquid crystal display panels as the display devices, power saving is a very important feature.

In order to reduce power consumption, in the liquid crystal display panel, a commonly used mode now is referred to as a charge sharing method. During the process of the charge sharing, a source driver typically performs polarity invertion of a display voltage once every frame is refreshed. When an invertion polarity switching signal is received, all source electrodes of the liquid crystal display panel are shorted together, to implement the charge sharing.

However, by performing charge sharing, although the power consumption can be reduced to some extent, yet needs of a next row of data are not taken into consideration. Therefore, if charge sharing is performed when the polarity is not switched, the voltage will be pulled to the vicinity of a common electrode voltage Vcom, and then is lifted (or lowered) to a desired voltage, which will incur more power consumption.

To this end, it is desirable to provide a driving method, a liquid crystal display panel and an electronic device, capable of selectively performing charge sharing between two data lines according to data difference between a previous row and a next row, so as to further reduce power consumption.

SUMMARY

An embodiment of the present application provides a driving method, applicable to a liquid crystal display panel, the liquid crystal display panel comprising a plurality of first data lines, the method comprising: grouping the plurality of first data lines into a plurality of sub-groups, each sub-group comprising a plurality of second data lines; determining a gray-scale value difference of data on each data line from a gray scale of a previous row to a gray scale of a next row, with respect to the plurality of second data lines of each sub-group; and selectively performing charge sharing with the plurality of second data lines in each sub-group, according to the determined gray-scale value difference.

Optionally, the method may further comprises: determining whether or not a polarity invertion signal is received, before selectively performing charge sharing with the plurality of second data lines in each sub-group according to the determined gray-scale value difference.

Optionally, when the polarity invertion signal is not received, selectively performing charge sharing with the plurality of second data lines in each sub-group according to the determined gray-scale value difference further comprises: sorting in a first mode according to an amount of the gray-scale value difference on each data line, in a plurality of third data lines having a positive polarity among the plurality of second data lines in each sub-group; sorting in the first mode according to an amount of the gray-scale value difference on each data line, in a plurality of fourth data lines having a negative polarity among the plurality of second data lines in each sub-group, the plurality of third data lines and the plurality of fourth data lines being same in number; performing charge sharing on every two data lines having opposite corresponding orders in the plurality of third data lines in each sub-group, and performing charge sharing on every two data lines having opposite corresponding orders in the plurality of fourth data lines in each sub-group.

Optionally, upon the polarity invertion signal being received, selectively performing charge sharing with the plurality of second data lines in each sub-group, according to the determined gray-scale value difference further comprises: sorting in a first mode according to an amount of the gray-scale value difference on each data line, in a plurality of third data lines having a positive polarity among the plurality of second data lines in each sub-group; sorting in the first mode according to an amount of the gray-scale value difference on each data line, in a plurality of fourth data lines having a negative polarity among the plurality of second data lines in each sub-group, the plurality of third data lines and the plurality of fourth data lines being same in number; performing charge sharing between data lines at a corresponding order in the plurality of third data lines and data lines at the corresponding order in a plurality of fourth data lines, in an order of the gray-scale value differences.

Optionally, upon the polarity invertion signal being received, charge sharing is performed between the plurality of first data lines.

Optionally, a number of plurality of second data lines is a multiple of four.

Another embodiment of the present application provides a liquid crystal display panel, comprising: a gate driver, a plurality of scanning lines being connected with the gate driver; a source driver, a plurality of first data lines being connected with the source driver, a plurality of pixel circuits, formed at intersection of the plurality of scanning lines and the plurality of data lines, and provided with display signals through the plurality of data lines; a control circuit, configured to control operation of respective circuits. The control circuit is configured to: group the plurality of first data lines into a plurality of sub-groups, each sub-group comprising a plurality of second data lines; determine a gray-scale value difference from a gray scale of a previous row and a gray scale of a current row on each data line, with respect to the plurality of second data lines of each sub-group; and selectively perform charge sharing between the plurality of second data lines of each sub-group.

Optionally, the control circuit is further configured to: determine whether or not a polarity invertion signal is received according to the determined gray-scale value difference, before selectively performing charge sharing with the plurality of second data lines of each sub-group.

Optionally, the control circuit is further configured to: when the polarity invertion signal is not received, sort in a first mode according to an amount of the gray-scale value difference on each data line, in a plurality of third data lines having a positive polarity among the plurality of second data lines in each sub-group; sort in the first mode according to an amount of the gray-scale value difference on each data line, in a plurality of fourth data lines having a negative polarity among the plurality of second data lines in each sub-group, the plurality of third data lines and the plurality of fourth data lines being same in number; perform charge sharing on every two data lines having opposite corresponding orders in the plurality of third data lines in each sub-group, and perform charge sharing on every two data lines having opposite corresponding orders in the plurality of fourth data lines in each sub-group.

Optionally, the control circuit is further configured to: upon the polarity invertion signal being received, sort in a first mode according to an amount of the gray-scale value difference on each data line, in a plurality of third data lines having a positive polarity among the plurality of second data lines in each sub-group; sort in the first mode according to an amount of the gray-scale value difference on each data line, in a plurality of fourth data lines having a negative polarity among the plurality of second data lines in each sub-group, the plurality of third data lines and the plurality of fourth data lines being same in number; perform charge sharing between data lines at a corresponding order in the plurality of third data lines and data lines at a corresponding order in a plurality of fourth data lines, in an order of the gray-scale value difference.

Optionally, the control circuit is further configured to: control the plurality of first data lines so as to perform charge sharing between the plurality of first data lines, upon a polarity invertion signal being received.

Optionally, the number of plurality of second data lines is a multiple of four.

Still another embodiment of the present application provides an electronic device, comprising the liquid crystal display panel according to any one of the above-mentioned embodiments.

Therefore, a driving method, a liquid crystal display panel and an electronic device according to embodiments of the present application, are capable of selectively performing charge sharing between two data lines according to data difference between a previous row and a next row, so as to further reduce power consumption.

DETAILED DESCRIPTION

Hereinafter, a driving method, a liquid crystal display panel, and an electronic device according to embodiments of the present application will be described in detail with reference to the accompanying drawings.

The driving method according to an embodiment of the present application may be applied to the liquid crystal display panel.

Prior to description of the driving method, the liquid crystal display panel, and the electronic device according to the embodiments of the present application, a structure of the liquid crystal display panel and a principle of charge sharing are briefly described with reference to FIG. 1.

Figure 1:
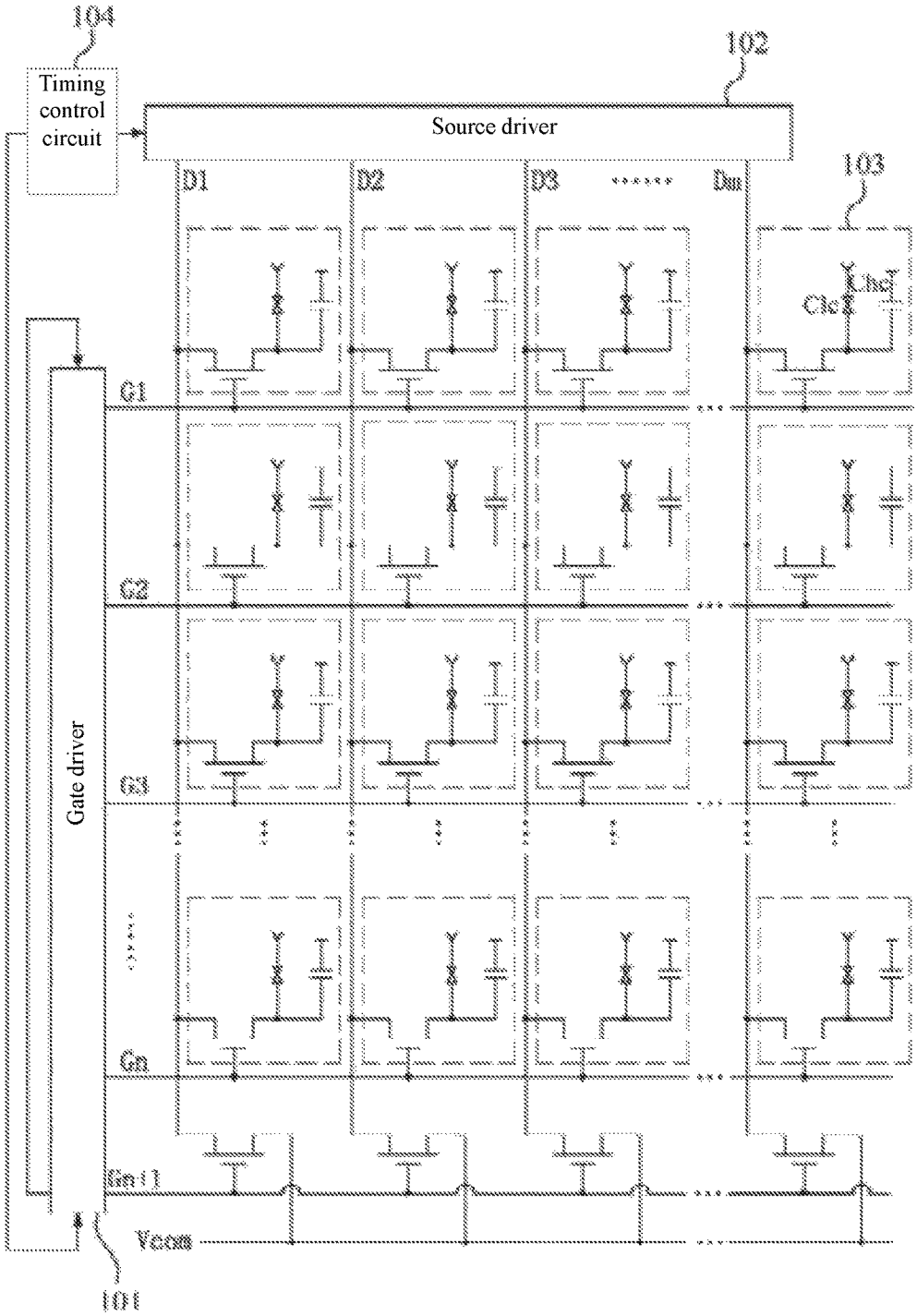
FIG. 1 is a circuit diagram illustrating a liquid crystal display panel according to the state of art.

As illustrated in FIG. 1, the liquid crystal display panel generally comprises a gate driver 101, a source driver 102, a plurality of scanning lines G1 to G11, a plurality of data lines D1 to Dm, and a plurality of pixel units 103 defined by the plurality of scanning lines and the plurality of data lines intersecting with each other, as well as a timing control circuit 104.

The plurality of scanning lines G1 to Gn are connected with the gate driver 101, and the gate driver 101 supplies gate driving signals to the plurality of pixel units 103 through the plurality of scanning lines G1 to Gn.

The plurality of data lines D1 to Dm are connected with the source driver 102, and the source driver 102 supplies display signals to the plurality of pixel units through the plurality of data lines D1 to Dm.

The pixel units 103 are each formed at intersections of the plurality of scanning lines and the plurality of data lines, and each includes, for example, a switching transistor 104. A gate electrode of the switching transistor 104 is connected with the scanning line to receive the gate driving signal. The switching transistor 104 is connected with the data line to receive the display signal. A drain electrode of the switching transistor 104 is connected with a liquid crystal capacitor Clc and a holding capacitor Chc.

The timing control circuit 104 controls operation timing of the respective circuits.

As is well known to those skilled in the art, in order to avoid the problem of direct-current (DC) residual image caused by movable ions in liquid crystal in the liquid crystal display panel, it is necessary to perform polarity invertion on the voltage across the liquid crystal capacitor of each pixel unit, so that display voltages supplied to the pixel unit have opposite polarities between the pictures of a previous frame and a next frame. A more commonly used polarity invertion driving mode includes frame invertion, row invertion, column invertion, point invertion, and Z-invertion.

Therefore, for a same data line, the voltage required to be output thereon has a positive polarity and a negative polarity alternatively, while with respect to the liquid crystal capacitor of each pixel unit, its charge and discharge power consumption is 0.5*f*Clc*V*V, where f is a frequency of a charge and discharge voltage, V is the charge and discharge voltage, that is, the display voltage, and Clc is the liquid crystal capacitor. In a liquid crystal display panel driven by polarity invertion, because the source driver needs to perform polarity invertion for the display voltage once every frame is refreshed, it is necessary to consume larger power. For example, with respect to a liquid crystal display panel driven by, e.g., point invertion and Z-invertion, the polarity invertion of the display voltage is performed once every frame is refreshed; besides, within each frame period, whenever each scanning line is scanned by the gate driving signal, the source driver must make the voltage of the display signal supplied by an output channel thereof corresponding to each data line subjected to polarity invertion once, so the required power consumption becomes greater.

Therefore, the mode for reducing power consumption in the state of art is just the so-called method of charge sharing. In the liquid crystal display panel using the charge sharing method, when the polarity of each frame is exchanged, all the source electrodes in the liquid crystal display panel are shorted together to perform charge sharing, so that the voltages thereof are pulled to the vicinity of a common electrode voltage Vcom. Then, the voltage of each row of data line is lifted (or lowered) to a desired voltage.

For example, as illustrated in FIG. 1, with an additionally supplied common electrode Vcom, during the charge sharing, all the source electrodes in the liquid crystal display panel are shorted together to implement charge sharing.

However, the problem of this approach is that all the source electrodes are simply shorted together, without taking into account data difference between a previous row and a next row over each data line, resulting in greater power consumption as well.

In addition, the charge sharing method can only perform charge switching when the polarity of each frame is switched, and thus, power consumption cannot be reduced in many cases.

In view of the above description, various embodiments of the present application have been made.

First Embodiment

Hereinafter, a driving method according to the first embodiment of the present application will be described in detail with reference to FIG. 2 and FIG. 3. In this embodiment, the description is conducted by taking Z-invertion as an example.

Figure 2:
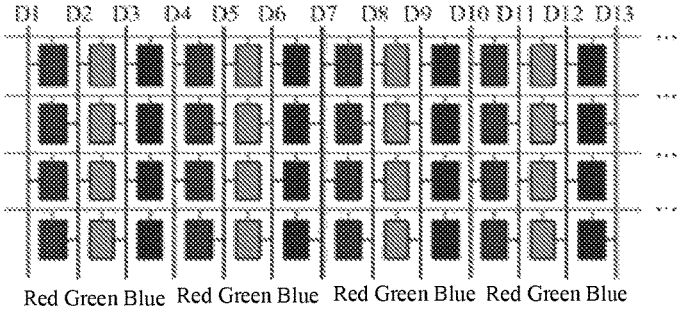
FIG. 2 is a circuit diagram illustrating a liquid crystal display panel using Z-invertion.

FIG. 2 is a circuit diagram illustrating a liquid crystal display panel using Z-invertion. As illustrated in FIG. 2, it is assumed that a plurality of columns of red, green and blue sub-pixels are sequentially arranged from left to right. Accordingly, a plurality of data lines (for example, m lines, m being a positive integer) are provided corresponding to each column of sub-pixels, and are alternately connected with sub-pixels in different rows. For example, with respect to the data line D2 of the second column, they are connected with a green sub-pixel in the first row, a red sub-pixel in the second row, a green sub-pixel in the third row, a red sub-pixel in the fourth row, . . . . With respect to the data line D3 in the third column, they are connected with a blue sub-pixel in the first row, a green sub-pixel in the second row, a blue sub-pixel in the third row, a green sub-pixel in the fourth row, . . . . Likewise, the data line for each column is respectively alternately connected with sub-pixels in different rows. In addition, display signals of positive polarity and negative polarity are alternately provided on the plurality of data lines.

In the liquid crystal display panel driven by Z-invertion, with respect to each data line, differences between data in a previous row and data in a next row are different. Thus, if all the voltages of the data lines are simply pulled together to the vicinity of the common electrode voltage Vcom, and then lifted (or lowered) to the desired voltages, it may result in more power consumption, which cannot save power.

Figure 3:
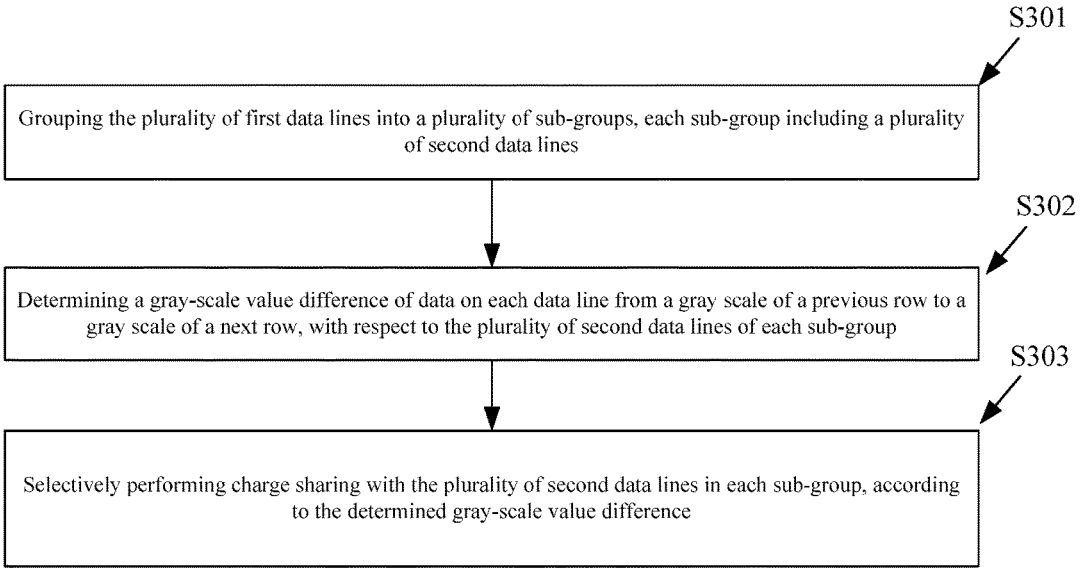
FIG. 3 is a flow chart illustrating a driving method according to a first embodiment of the present application.

Thus, as illustrated in FIG. 3, the driving method according to the first embodiment of the present application is applied to, for example, the liquid crystal display panel using Z-invertion as shown in FIG. 2, the liquid crystal display panel comprising a plurality of first data lines (for example, m lines, m being a positive integer), the method comprising the following operations:

Step S301: grouping the plurality of first data lines into a plurality of sub-groups, each sub-group including a plurality of second data lines;

Step S302: determining a gray-scale value difference of data on each data line from a gray scale of a previous row to a gray scale of a next row, with respect to the plurality of second data lines of each sub-group; and Step S303: selectively performing charge sharing with the plurality of second data lines in each sub-group, according to the determined gray-scale value difference.

Specifically, in step S301, m data lines are divided into a plurality of sub-groups, in an order of data line arrangement, each sub-group including a plurality of second data lines (e.g., n lines, n being a positive integer). For example, in the embodiment shown in FIG. 2, it is illustrated with n being 12 as an example. It should be noted that, n is not limited to 12, for example, it may also be 8, 16, 20, 20, etc., as long as n is a multiple of four.

Then, in step S302, with respect to the plurality of second data lines of each sub-group, the gray-scale value difference of the data on each data line from the gray scale of the previous row to the gray scale of the next row is determined.

Specifically, for example, with respect to the 12 data lines as shown in FIG. 2, firstly, the gray-scale value of the previous row of each data line is determined, that is to say, a display signal voltage previously outputted on each data line is determined. Then, the gray-scale value of the next row of each data line is determined, that is to say, a display signal voltage to be outputted on each data line is determined. Then, according to the display signal voltage previously outputted and the display signal voltage to be outputted on each data line, the amount of transition or jump of the display signal voltage each time on each data line, i.e., the gray-scale value difference, is determined.

For example, the gray-scale value difference may be determined according to Formula 1 below:

$$G_n = G''_n - G'_n \qquad \text{Formula 1}$$

where Gn denotes the gray-scale value by which the data has jumped on the nth data line, Gn' denotes the gray scale of the previous row of the data on the nth data line, and Gn" denotes the gray scale of the next row of the data on the nth data line.

Gn, Gn' and Gn" all have symbols of "+" or "−". For example, Gn=−100−(+90)=−190 denotes a gray scale jump from the gray scale of a positive polarity of 90 to the gray scale of a negative polarity of 100, and at this time, the gray-scale value difference is −190. For example, Gn=100−(+90) represents a gray scale jumping from the gray scale of a positive polarity of 90 to the gray scale of a positive polarity of 100, and at this time, the gray-scale value difference is 10.

Thus, it is possible to derive the jump of the gray-scale value of the 12 data lines, 6 gray scale transitions of the positive polarity and 6 gray scale transitions of the negative polarity are sorted in a first mode, for example, in an order from large to small:

Positive polarity: G1>G3>G5>G7>G9>G11

Negative polarity: G2>G6>G4>G10>G8>G12

Alternatively, it is also possible to sort in an order from small to large.

Finally, in step S303, in each sub-group, according to the determined gray-scale value difference, charge sharing is selectively performed with the plurality of second data lines in each sub-group.

That is to say, unlike the mode in the state of art in which the voltages of all the data lines are pulled together to the vicinity of the common electrode voltage Vcom, in the driving method according to the first embodiment of the present application, based on the value difference from the gray scale of the previous row to the gray scale of the next row on the data line (i.e., the voltage difference of the transiting display signal), two data lines are selected to be subjected to the charge sharing according to a predetermined strategy, so as to obtain a neutralized voltage, and then from the obtained neutralized voltage are respectively lifted (or lowered) to the desired voltages. Because the neutralized voltage is closer to the desired voltages, it is more power efficient.

Therefore, in the driving method according to the first embodiment of the present application, it is possible to selectively perform charge sharing between the two data lines, according to the data difference between the previous row and the next row, so as to further save power.

Second Embodiment

Hereinafter, a driving method according to the second embodiment of the present application will be described in detail with reference to FIG. 2 and FIG. 4. In this embodiment, also description is conduced by taking the liquid crystal display panel using Z-invertion as an example.

Figure 4:
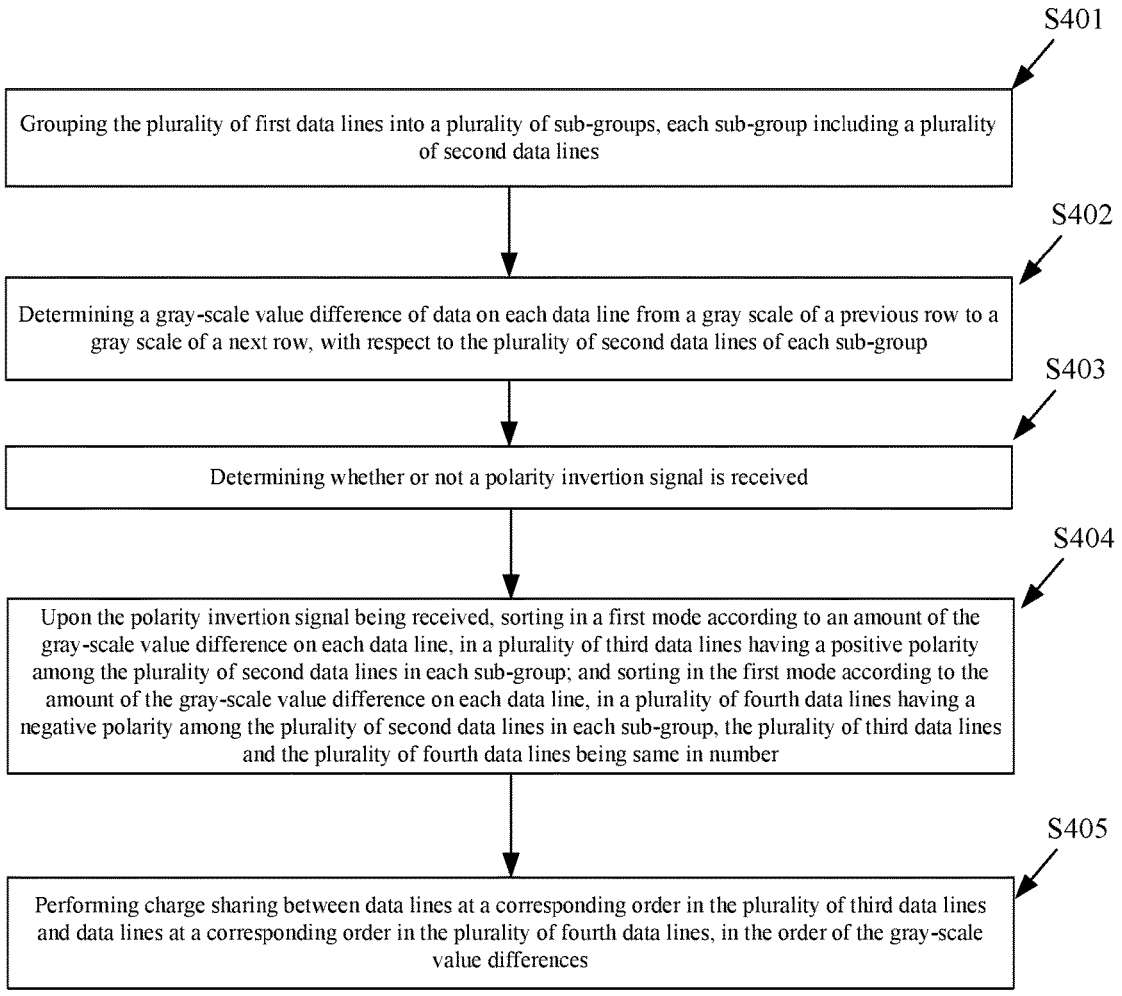
FIG. 4 is a flow chart illustrating a driving method according to a second embodiment of the present application.

As illustrated in FIG. 4, the driving method according to the second embodiment of the present application is applied to, for example, the liquid crystal display panel using Z-invertion as shown in FIG. 2, the liquid crystal display panel comprising a plurality of first data lines (for example, in lines, m being a positive integer), the method comprising the following operations:

Step S401: grouping the plurality of first data lines into a plurality of sub-groups, each sub-group including a plurality of second data lines;

Step S402: determining a gray-scale value difference of data on each data line from a gray scale of a previous row to a gray scale of a next row, with respect to the plurality of second data lines of each sub-group;

Step S403: determining whether or not a polarity invertion signal is received; and Step S404: upon the polarity invertion signal being received, sorting in a first mode according to an amount of the gray-scale value difference on each data line, in a plurality of third data lines having a positive polarity among the plurality of second data lines in each sub-group; and sorting in the first mode according to the amount of the gray-scale value difference on each data line, in a plurality of fourth data lines having a negative polarity among the plurality of second data lines in each sub-group, the plurality of third data lines and the plurality of fourth data lines being same in number;

Step S405: performing charge sharing between data lines at a corresponding order in the plurality of third data lines and data lines at a corresponding order in the plurality of fourth data lines, in the order of the gray-scale value differences.

Specifically, in step S401, m data lines are divided into a plurality of sub-groups, each sub-group including a plurality of second data lines (e.g., n lines, n being a positive integer). For example, in the embodiment shown in FIG. 2, it is illustrated with n being 12 as an example. It should be noted that, n is not limited to 12, for example, it may also be 8, 16, 20, 20, etc., as long as n is a multiple of four.

Then, in step S402, with respect to the plurality of second data lines of each sub-group, the gray-scale value difference of the data on each data line from the gray scale of the previous row to the gray scale of the next row is determined.

Specifically, for example, with respect to the 12 data lines as shown in FIG. 2, firstly, the gray-scale value of the previous row of each data line is determined, that is to say, the display signal voltage previously outputted on each data line is determined. Then, the gray-scale value of the next row of each data line is determined, that is to say, the display signal voltage to be outputted on each data line is determined. Then, according to the display signal voltage previously outputted and the display signal voltage to be outputted on each data line, the amount of transition or jump of the display signal voltage each time on each data line, i.e., the gray-scale value difference, is determined.

For example, the gray-scale value differences G1 to G12 of the 12 data lines in each sub-group may be determined according to Formula 1 above.

Then, in step S403, it is determined whether or not the polarity invertion signal is received. As described above, display signals of the positive polarity and the negative polarity are alternately provided on the plurality of data lines of the liquid crystal display panel. The polarity of the display signal on each data line is usually switched frame by frame, i.e., in units of frames.

If the polarity invertion signal (the POL signal) is received, then it is indicated that polarities of the signals on all data lines are to be inverted. If the polarity invertion signal (the POI, signal) is not received, then it is indicated that the polarities of the signals on all data lines do not need to be inverted. For example, the display signal remains the original polarity, but the amplitude of the display signal will change.

Then, in step S404, upon the polarity invertion signal being received, sorting is performed in the first mode according to the amount of gray-scale value difference on each data line, in the plurality of third data lines having the positive polarity among the plurality of second data lines in each sub-group; and sorting is performed in the first mode according to the amount of the gray-scale value difference on each data line, in the plurality of fourth data lines having the negative polarity among the plurality of second data lines in each sub-group, the plurality of third data lines and the plurality of fourth data lines being the same in number.

Specifically, with respect to the transition gray scale values G1 to G12 of the 12 data lines derived in step S402, according to the signal polarities of the data lines, the 6 transition gray scales having the positive polarity and the 6 transition gray scales having the negative polarity are sorted by amount, for example, in an order from large to small:

Positive polarity: G1>G3>G5>G7>G9>G11

Negative polarity: G2>G6>G4>G10>G8>G12

Alternatively, it is also possible to sort in an order from small to large.

Finally, in step S405, in the order of the gray-scale value difference, charge sharing is performed between the data lines at the corresponding order in the plurality of third data lines and the data lines having at the corresponding order in the plurality of fourth data lines.

It should be noted that, upon the polarity invertion signal being received, with respect to the data line having the positive polarity, due to polarity invertion, they all are switched to the negative polarity. At this time, sorting is performed with the absolute values of the jump amounts as a basis. Similarly, upon the polarity invertion signal being received, with respect to the data line having the negative polarity, due to polarity invertion, they all are switched to the positive polarity. At this time, sorting is performed with the absolute values of the jump amounts as a basis.

Specifically, charge sharing is performed between a data line having the largest positive polarity transition value G1 and a data line having the largest negative polarity transition value G2, charge sharing is performed between a data line having the second largest positive polarity transition value G3 and a data line having the second largest negative polarity transition value G6, charge sharing is performed between a data line having the third largest positive polarity transition value G5 and a data line having the third largest negative polarity transition value G4, and so on, to complete pairwise coupling of the data lines in each sub-group.

That is to say, unlike the mode in the state of art in which the voltages of all the data lines are pulled together to the vicinity of the common electrode voltage Vcom, in the driving method according to the second embodiment of the present application, based on the amount difference from the gray scale of the previous row to the gray scale of the next row on the data line (i.e., the voltage difference of the transiting display signal), upon the polarity invertion signal being received, between the data lines having different polarities, two data lines having the corresponding gray-scale value differences are selected to be subjected to the charge sharing, so as to obtain a neutralized voltage, and then from the obtained neutralized voltage are respectively lifted (or lowered) to the desired voltage. Because the neutralized charge is closer to the desired voltage, it is more power efficient.

Therefore, in the driving method according to the second embodiment of the present application, it is possible to selectively perform charge sharing between the two data lines, according to data difference between the previous row and the next row, and according to whether or not the polarity invertion signal is received, so as to further save power.

Third Embodiment

Hereinafter, a driving method according to the third embodiment of the present application will be described in detail with reference to FIG. 2 and FIG. 5. In this embodiment, also description is conducted by taking the liquid crystal display panel using Z-invertion as an example.

Figure 5:
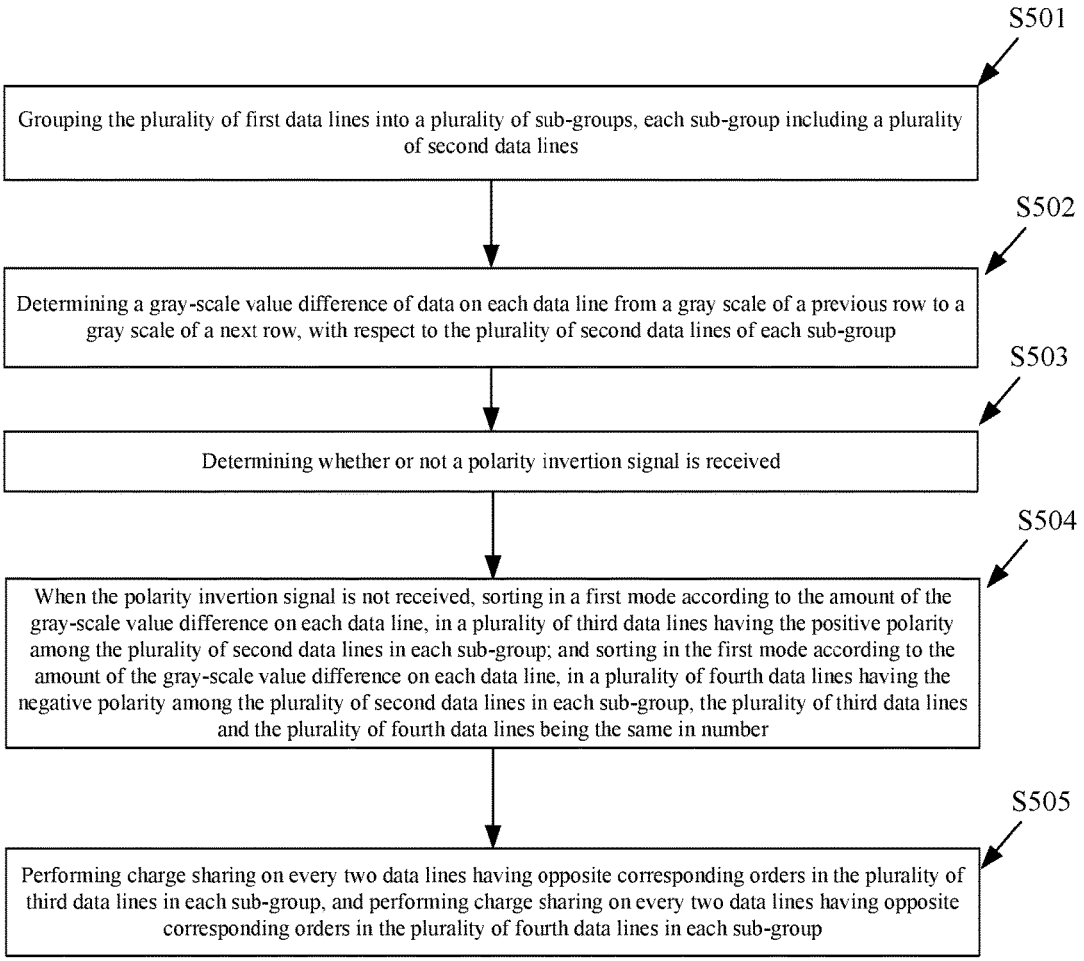
FIG. 5 is a flow chart illustrating a driving method according to a third embodiment of the present application.

As illustrated in FIG. 5, the driving method according to the third embodiment of the present application is applied to, for example, the liquid crystal display panel using Z-invertion as shown in FIG. 2, the liquid crystal display panel comprising a plurality of first data lines (for example, m lines, m being a positive integer), the method comprising the following operations:

Step S501: grouping the plurality of first data lines into a plurality of sub-groups, each sub-group including a plurality of second data lines;

Step S502: determining a gray-scale value difference of data on each data line from a gray scale of a previous row to a gray scale of a next row, with respect to the plurality of second data lines of each sub-group;

Step S503: determining whether or not a polarity invertion signal is received; and Step S504: when the polarity invertion signal is not received, sorting in a first mode according to the amount of the gray-scale value difference on each data line, in a plurality of third data lines having the positive polarity among the plurality of second data lines in each sub-group; and sorting in the first mode according to the amount of the gray-scale value difference on each data line, in a plurality of fourth data lines having the negative polarity among the plurality of second data lines in each sub-group, the plurality of third data lines and the plurality of fourth data lines being the same in number;

Step S505: performing charge sharing on every two data lines having opposite corresponding orders in the plurality of third data lines in each sub-group, and performing charge sharing on every two data lines having opposite corresponding orders in the plurality of fourth data lines in each sub-group.

Specifically, in step S501, m data lines are divided into a plurality of sub-groups, each sub-group including a plurality of second data lines (e.g., n lines, n being a positive integer). For example, in the embodiment shown in FIG. 2, it is illustrated with n being 12 as an example. It should be noted that, n is not limited to 12, for example, it may also be 8, 16, 20, 20, etc., as long as 11 is a multiple of four.

Then, in step S502, with respect to the plurality of second data lines of each sub-group, the gray-scale value difference of the data on each data line from the gray scale of the previous row to the gray scale of the next row is determined.

Specifically, for example, with respect to the 12 data lines as shown in FIG. 2, firstly, the gray-scale value of the previous row of each data line is determined, that is to say, the display signal voltage previously outputted on each data line is determined. Then, the gray-scale value of the next row of each data line is determined, that is to say, the display signal voltage to be outputted on each data line is determined. Then, according to the display signal voltage previously outputted and the display signal voltage to be outputted on each data line, an amount of transition of the display signal voltage each time on each data line, i.e., the gray-scale value difference, is determined.

For example, the gray-scale value differences G1 to G12 of the 12 data lines in each sub-group may be determined according to Formula 1 above.

Then, in step S503, it is determined whether or not the polarity invertion signal is received. As described above, display signals of the positive polarity and the negative polarity are alternately provided on the plurality of data lines of the liquid crystal display panel. The polarity of the display signal on each data line is usually switched in units of frames.

If the polarity invertion signal (the POL signal) is received, then it is indicated that polarities of the signal on all data lines are to be inverted. If the polarity invertion signal (the POL signal) is not received, then it is indicated that the polarities of the signal on all data lines do not need to be inverted. For example, the display signal remains the original polarity, but the amount of the display signal will change.

Then, in step S504, when the polarity invertion signal is not received, sorting is performed in a first mode according to the amount of the gray-scale value difference on each data line, in the plurality of third data lines having the positive polarity among the plurality of second data lines in each sub-group; and sorting is performed in the first mode according to the amount of the gray-scale value difference on each data line, in the plurality of fourth data lines having the negative polarity among the plurality of second data lines in each sub-group, the plurality of third data lines and the plurality of fourth data lines being the same in number.

Specifically, with respect to the transition gray scale numbers G1 to G12 of the 12 data lines derived in step S502, according to the signal polarities of the data lines, the 6 transition gray scales having the positive polarity and the 6 transition gray scales having the negative polarity are sorted by size, for example, in an order from large to small:

Positive polarity: G1>G3>G5>G7>G9>G11

Negative polarity: G2>G6>G4>G10>G8>G12

Alternatively, it is also possible to sort in an order from small to large.

It should be noted that, when the polarity invertion signal is not received, with respect to the data line having the positive polarity, because the polarity is not inverted, the transition amount may be either positive or negative. At this time, sorting is performed with the value of a transition amount having a symbol as a basis. That is, the value of a transition amount which is positive is greater than the value of a transition amount which is negative. Similarly, with respect to the data line having the negative polarity, because the polarity is not inverted, the transition amount may be either positive or negative. At this time, sorting is performed with the value of a transition amount having a symbol as a basis. That is, the value of a transition amount which is positive is greater than the value of a transition amount which is negative.

Finally, in step S505, in the order of the gray-scale value differences, charge sharing is performed between the data line having the largest gray-scale value difference and the data line having the smallest gray-scale value difference among the plurality of third data lines in each sub-group, and in the same way charge sharing is performed on every two data lines, and charge sharing is performed between the data line having the largest gray-scale value difference and the data line having the smallest gray-scale value difference among the plurality of fourth data lines in each sub-group, and charge sharing is performed on every two data lines.

That is to say, unlike the driving method according to the second embodiment as described above, in this embodiment, when the polarity invertion signal is not received, the charge sharing is not performed between data lines of different polarities. On the contrary, charge sharing is performed between data lines having the same polarity so as to avoid the case where the voltage of the source electrode is pulled to an undesired voltage and then respectively lifted (or lowered) to the desired voltage.

Specifically, in the data lines G1, G3, G5, G7, G9 and G11 having the positive polarity, charge sharing is performed between the data line G1 which is the largest and the data line G11 which is the smallest, charge sharing is performed between the data line G3 which is the second largest and the data line G9 which is the second smallest, charge sharing is performed between the data line G5 which is the third largest and the data line G9 which is the third smallest, so the pairwise coupling between the data lines having the positive polarity in each sub-group is conducted.

Similarly, in the data lines G2, G4, G6, G8, G10 and G12 having the negative polarity, charge sharing is performed between the data line G2 which is the largest and the data line G12 which is the smallest, charge sharing is performed between the data line G4 which is the second largest and the data line G10 which is the second smallest, charge sharing is performed between the data line G6 which is the third largest and the data line G8 which is the third smallest, so that pairwise coupling between the data lines having the negative polarity in each sub-group is conducted.

That is to say, unlike the mode in the state of art in which the voltages of all the data lines are pulled together to the vicinity of the common electrode voltage Vcom, in the driving method according to the third embodiment of the present application, based on the amount difference from the gray scale of the previous row to the gray scale of the next row on the data line (i.e., the voltage difference of the transiting display signal), when the polarity invertion signal is not received, between the data lines having the same polarity, two data lines having the opposite corresponding orders of the gray-scale value differences are selected to be subjected to the charge sharing, so as to obtain a neutralized voltage, and then from the obtained neutralized voltage are respectively lifted (or lowered) to the desired voltage. Because the neutralized charge is closer to the desired voltage, it is more power efficient.

Therefore, in the driving method according to the third embodiment of the present application, it is possible to selectively perform the charge sharing between the two data lines, according to data difference between the previous row and the next row, even in a case where the polarity invertion signal is not received, so as to further save power.

Fourth Embodiment

Hereinafter, a driving method according to the fourth embodiment of the present application will be described in detail with reference to FIG. 2 and FIG. 6. In this embodiment, also description is conducted by taking the liquid crystal display panel using Z-invertion as an example.

Figure 6:
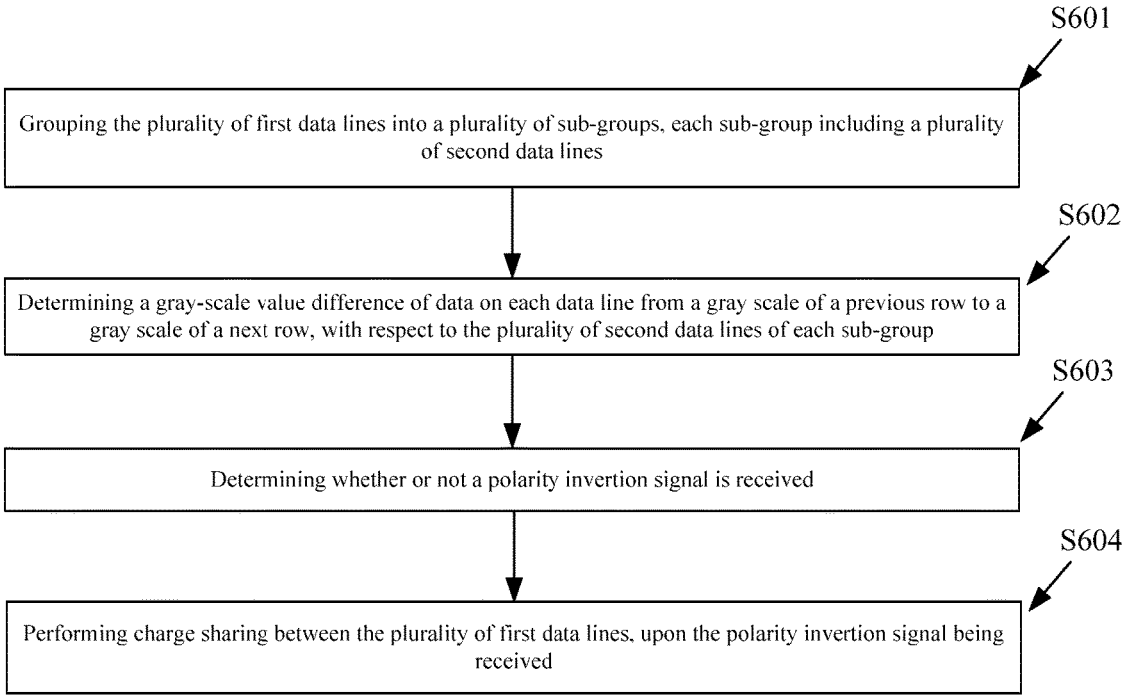
FIG. 6 is a flow chart illustrating a driving method according to a fourth embodiment of the present application.

As illustrated in FIG. 6, the driving method according to the fourth embodiment of the present application is applied to, for example, the liquid crystal display panel using Z-invertion as shown in FIG. 2, the liquid crystal display panel comprising a plurality of first data lines (for example, m lines, m being a positive integer), the method comprising the following operations:

Step S601: grouping the plurality of first data lines into a plurality of sub-groups, each sub-group including a plurality of second data lines;

Step S602: determining a gray-scale value difference of data on each data line from a gray scale of a previous row to a gray scale of a next row, with respect to the plurality of second data lines of each sub-group;

Step S603: determining whether or not a polarity invertion signal is received; and Step S604: performing charge sharing between the plurality of first data lines, upon the polarity invertion signal being received.

The steps S601 to S603 are substantially the same as the steps S401 to S403 in the second embodiment, and detailed description thereof is omitted here.

Unlike the driving method according to the second embodiment, upon the polarity invertion signal being received in step S603, charge sharing is performed between the plurality of first data lines.

Therefore, in the driving method according to the fourth embodiment of the present application, it is possible to perform charge sharing among the plurality of data lines, according to data difference between the previous row and the next row, in a case where the polarity invertion signal is received, so as to further save power.

Fifth Embodiment

Figure 7:
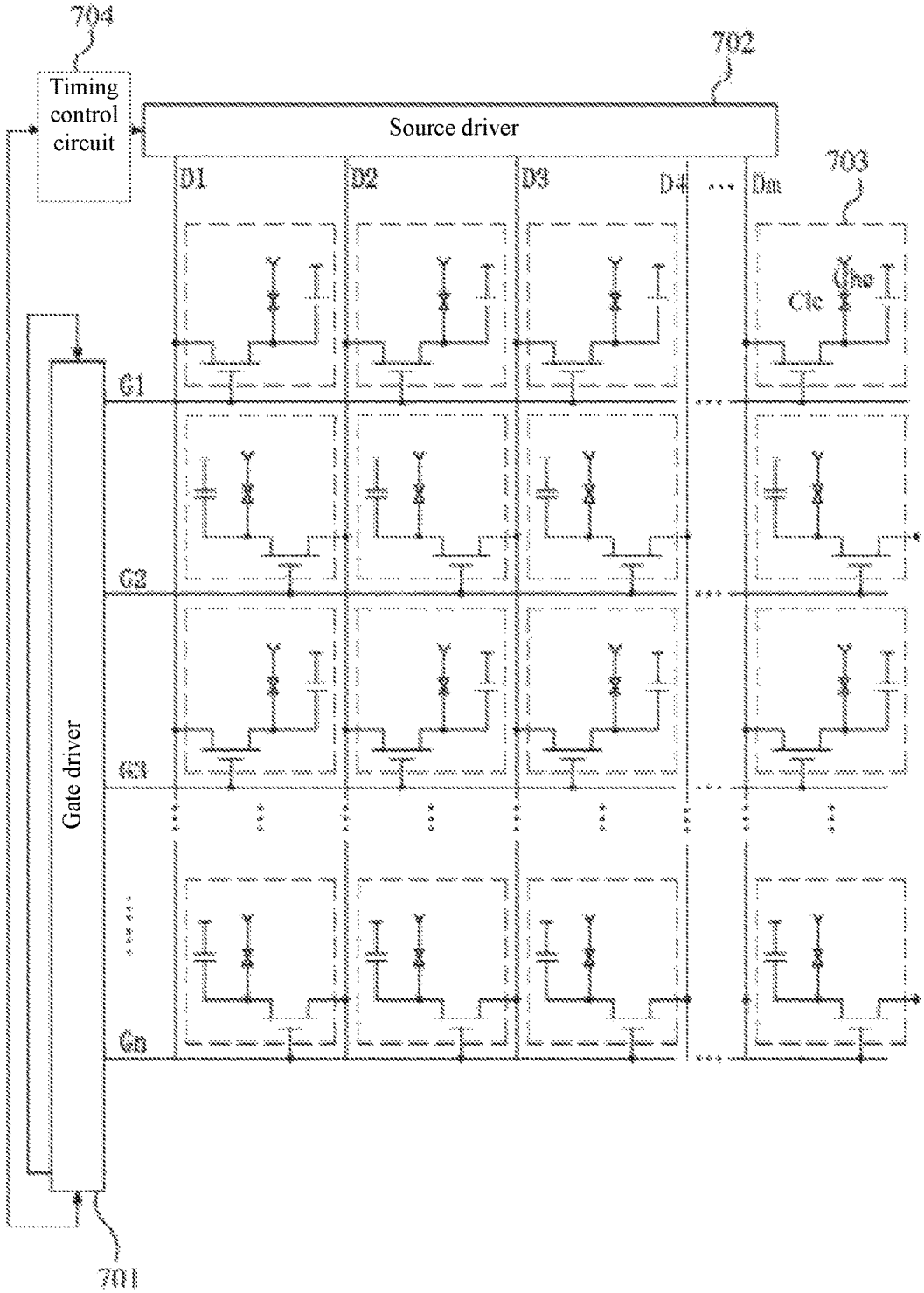
FIG. 7 is a configuration block diagram illustrating a liquid crystal display panel according to a fifth embodiment of the present application.

Hereinafter, a liquid crystal display panel according to the fourth embodiment of the present application will be described in detail with reference to FIG. 7. As illustrated in FIG. 7, the liquid crystal display panel 700 according to the fifth embodiment of the present application comprises: a gate driver 701, a plurality of scanning lines being connected with the gate driver; a source driver 702, a plurality of first data lines being connected with the source driver, a plurality of pixel circuits 703, formed at intersections of the plurality of scanning lines and the plurality of data lines, and provided with display signals through the plurality of data lines; a control circuit 704, configured to control operation of respective circuits. The control circuit 704 groups the plurality of first data lines into a plurality of sub-groups, each sub-group including a plurality of second data lines; determines gray-scale value difference from a gray scale of a previous row and a gray scale of a current row on each data line, with respect to the plurality of second data lines of each sub-group; and selectively performs charge sharing between the plurality of second data lines of each sub-group.

Arrangement of the gate driver 701, the source driver 702, the plurality of pixel circuits 703, the scanning lines, and the data lines is similar to that in the liquid crystal display panel as described with reference to FIG. 1, and detailed description thereof is omitted here.

Unlike the liquid crystal display panel as shown in FIG. 1, the control circuit 704 is used in the present application. The control circuit 704 may be implemented, for example, with an integrated circuit chip of a display driver IC. The control circuit 704 is capable of controlling operation of respective circuits.

In one embodiment, the control circuit 704 is further configured to determine whether or not a polarity invertion signal is received, before the selectively performing charge sharing with the plurality of second data lines of each sub-group according to the determined gray-scale value difference.

Specifically, the control circuit 704 is further configured to: sort in a first mode according to the amount of the gray-scale value difference on each data line, in a plurality of third data lines having a positive polarity among the plurality of second data lines in each sub-group; sort in the first mode according to the amount of the gray-scale value difference on each data line, in a plurality of fourth data lines having a negative polarity among the plurality of second data lines in each sub-group, the plurality of third data lines and the plurality of fourth data lines being same in number; perform charge sharing between data lines at a corresponding order in the plurality of third data lines and data lines at a corresponding order in a plurality of fourth data lines, in the order of the gray-scale value difference.

In another embodiment, the control circuit 704 is further configured to: sort in a first mode according to the amount of the gray-scale value difference on each data line, in a plurality of third data lines having a positive polarity among the plurality of second data lines in each sub-group; sort in the first mode according to the amount of the gray-scale value difference on each data line, in a plurality of fourth data lines having a negative polarity among the plurality of second data lines in each sub-group, the plurality of third data lines and the plurality of fourth data lines being same in number; in the order of the gray-scale value differences, perform charge sharing between the data line having the largest gray-scale value difference and the data line having the smallest gray-scale value difference among the plurality of third data lines in each sub-group, and perform charge sharing in a same mode on every two data lines in the plurality of third data lines, perform charge sharing between the data line having the largest gray-scale value difference and the data line having the smallest gray-scale value difference among the plurality of fourth data lines in each sub-group, and perform charge sharing in a same mode on every two data lines in the plurality of fourth data lines.

In another embodiment, the control circuit 704 is further configured to: control the plurality of first data lines so as to perform charge sharing between the plurality of first data lines, when a polarity invertion signal is received.

Optionally, the number of the plurality of second data lines is a multiple of four.

The control circuit 704 may control any one of the plurality of data lines to perform charge sharing.

Therefore, with the liquid crystal display panel according to the fifth embodiment of the present application, it is possible to selectively perform charge sharing between two data lines according to data difference between a previous row and a next row, so as to further save power.

Sixth Embodiment

Figure 8:
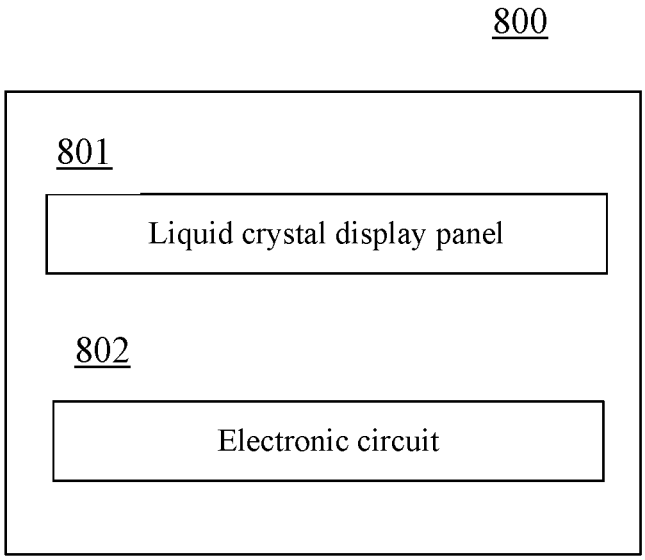
FIG. 8 is a configuration block diagram illustrating an electronic device according to a sixth embodiment of the present application.

FIG. 8 is a configuration block diagram illustrating an electronic device 800 according to the sixth embodiment of the present application.

As illustrated in FIG. 8, the electronic device 800 comprises: a liquid crystal display panel 801 and an electronic circuit 802.

The liquid crystal display panel 801 may be, for example, a liquid crystal display panel according to the fifth embodiment. The liquid crystal display panel 801 is capable of selectively performing charge sharing between the two data lines, according to data difference between the previous row and the next row, so as to further save power.

The electronic circuit 802 is collectively referred to an electronic component other than the liquid crystal display panel 801 in the electronic device 800, and may include, for example, a processor, a memory, an input/output interface, and the like.

Various programs may be stored in the memory, and when executed, may output various graphical user interfaces to the liquid crystal display panel 801.

Because the liquid crystal display panel according to the fifth embodiment is used in the electronic device 800, the electronic device 800 can also achieve low power consumption.

It should be noted that the above embodiments are used as examples only; and the present application is not limited thereto, and various modifications can be conducted to the embodiments.

It should be noted that, in the present specification, the term "comprising", "including" or any other variation thereof are intended to cover a non-exclusive inclusion, such that a process, a method, an article or a device including a series of elements not only includes these elements, but also include other elements that are not explicitly listed, or further include inherent elements of such process, method, article or device. Without more limitations, the elements defined by the statement of "comprises one . . . " does not exclusive of other same elements in the process, method, article and device.

Finally, it should be explained that a series of processes above comprise the processes carried out according to the time sequence as described herein, and the processes carried out in parallel or separately, not in accordance with the time sequence.

Through the above description of the implementation modes, a person of skill in the art can clearly know that the present application can be implemented by a software plus necessary hardware platform, of course, it can also be wholly executed by the hardware. Based on such understanding, the contribution of the technical solution of the present application to the background art can be partially or entirely embodied in the form of software product; the computer software product can be stored in the medium, such as ROM (read-only memory)/RAM (random-access memory), disk, CD-ROM and the like, including instructions, through which one computer device (it can be a personal computer, a server, or a network device, etc.) can execute the method described in each embodiment or some part of the embodiment.

The present application is described above in detail, wherein the principle and implementation mode of the present application are elaborated by special examples; and the above described embodiments are only used to help understand the method and core thought of the present application; at the same time, for a person of ordinary skill in the art, the actual implementation mode and application scope can be changed according to the thought of the present application. In summary, the present specification shall not be construed as limiting the present application.

The present application claims priority of the Chinese Patent Application No. 201610387732.X filed on Jun. 2, 2016, the disclosure of which are incorporated herein by its reference in its entirety as part of the present application.

What is claimed is:

1. A driving method, applicable to a liquid crystal display panel, the liquid crystal display panel comprising a plurality of first data lines, the method comprising:

grouping the plurality of first data lines into a plurality of sub-groups, each sub-group comprising a plurality of second data lines;

determining a gray-scale value difference of data on each data line from a gray scale of a previous row to a gray scale of a next row, with respect to the plurality of second data lines of each sub-group; and determining an order of gray-scale value difference of the plurality of second data lines of each sub-group, and selectively performing in a pairwise manner charge sharing on the plurality of second data lines in each sub-group, according to the determined order.

2. The method according to claim 1, further comprising:

determining whether or not a polarity invertion signal is received, before determining the order of gray-scale value differences of the plurality of second data lines of each sub-group, and selectively performing in a pairwise manner charge sharing on the plurality of second data lines in each sub-group according to the determined order.

3. The method according to claim 2, wherein, when the polarity invertion signal is not received, determining the order of gray-scale value differences of the plurality of second data lines of each sub-group, and selectively performing in a pairwise manner charge sharing on the plurality of second data lines in each sub-group according to the determined order further comprises:

sorting in a first mode according to an amount of the gray-scale value difference on each data line, in a plurality of third data lines having a positive polarity among the plurality of second data lines in each sub-group;

sorting in the first mode according to an amount of the gray-scale value difference on each data line, in a plurality of fourth data lines having a negative polarity among the plurality of second data lines in each sub-group, the plurality of third data lines and the plurality of fourth data lines being same in number;

performing charge sharing on every two data lines having opposite corresponding orders in the plurality of third data lines in each sub-group, and performing charge sharing on every two data lines having opposite corresponding orders in the plurality of fourth data lines in each sub-group.

4. The method according to claim 2, wherein, upon the polarity invertion signal being received, determining the order of gray-scale value differences of the plurality of second data lines of each sub-group, and selectively performing in a pairwise manner charge sharing on the plurality of second data lines in each sub-group, according to the determined order further comprises:

sorting in a first mode according to an amount of the gray-scale value difference on each data line, in a plurality of third data lines having a positive polarity among the plurality of second data lines in each sub-group;

sorting in the first mode according to an amount of the gray-scale value difference on each data line, in a plurality of fourth data lines having a negative polarity among the plurality of second data lines in each sub-group, the plurality of third data lines and the plurality of fourth data lines being same in number;

performing charge sharing between data lines at a corresponding order in the plurality of third data lines and data lines at the corresponding order in a plurality of fourth data lines, in an order of the gray-scale value differences.

5. The method according to claim 2, wherein, upon the polarity invertion signal being received, charge sharing is performed between the plurality of first data lines.

6. The method according to claim 1, wherein, a number of plurality of second data lines is a multiple of four.

7. A liquid crystal display panel, comprising:

a gate driver, a plurality of scanning lines being connected with the gate driver;

a source driver, a plurality of first data lines being connected with the source driver, a plurality of pixel circuits, formed at intersection of the plurality of scanning lines and the plurality of data lines, and provided with display signals through the plurality of data lines;

a control circuit, configured to control operation of respective circuits, wherein, the control circuit is configured to: group the plurality of first data lines into a plurality of sub-groups, each sub-group comprising a plurality of second data lines; determine a gray-scale value difference from a gray scale of a previous row and a gray scale of a current row on each data line, with respect to the plurality of second data lines of each sub-group; and determine an order of gray-scale value differences of the plurality of second data lines of each sub-group, and selectively perform in a pairwise manner charge sharing on the plurality of second data lines of each sub-group according to the determined order.

8. The liquid crystal display panel according to claim 7, wherein, the control circuit is further configured to:

determine whether or not a polarity invertion signal is received according to the determined gray-scale value difference, before determining the order of gray-scale value differences of the plurality of second data lines of each sub-group, and selectively performing in a pairwise manner charge sharing on the plurality of second data lines of each sub-group according to the determined order.

9. The liquid crystal display panel according to claim 8, wherein, the control circuit is further configured to:

when the polarity invertion signal is not received, sort in a first mode according to an amount of the gray-scale value difference on each data line, in a plurality of third data lines having a positive polarity among the plurality of second data lines in each sub-group;

sort in the first mode according to an amount of the gray-scale value difference on each data line, in a plurality of fourth data lines having a negative polarity among the plurality of second data lines in each sub-group, the plurality of third data lines and the plurality of fourth data lines being same in number;

perform charge sharing on every two data lines having opposite corresponding orders in the plurality of third data lines in each sub-group, and perform charge sharing on every two data lines having opposite corresponding orders in the plurality of fourth data lines in each sub-group.

10. The liquid crystal display panel according to claim 8, wherein, the control circuit is further configured to:

upon the polarity invertion signal being received, sort in a first mode according to an amount of the gray-scale value difference on each data line, in a plurality of third data lines having a positive polarity among the plurality of second data lines in each sub-group;

sort in the first mode according to an amount of the gray-scale value difference on each data line, in a plurality of fourth data lines having a negative polarity among the plurality of second data lines in each sub-group, the plurality of third data lines and the plurality of fourth data lines being same in number;

perform charge sharing between data lines at a corresponding order in the plurality of third data lines and data lines at a corresponding order in a plurality of fourth data lines, in an order of the gray-scale value difference.

11. The liquid crystal display panel according to claim 8, wherein, the control circuit is further configured to:

control the plurality of first data lines so as to perform charge sharing between the plurality of first data lines, upon a polarity invertion signal being received.

12. The liquid crystal display panel according to claim 7, wherein, a number of plurality of second data lines is a multiple of four.

13. An electronic device, comprising the liquid crystal display panel according to claim 7.

* * * * *